US008273195B2

(12) United States Patent
Toyoshima et al.

(10) Patent No.: US 8,273,195 B2
(45) Date of Patent: Sep. 25, 2012

(54) HIGH-STRENGTH STEEL TUBE AND HEAT TREATMENT METHOD OF HEAT-TREATING THE SAME

(75) Inventors: Hideki Toyoshima, Saitama-Ken (JP); Yukari Nakazawa, Koga (JP)

(73) Assignee: Sanoh Kogyo Kabushiki Kaisha, Tokyo (JP)

( * ) Notice: Subject to any disclaimer, the term of this patent is extended or adjusted under 35 U.S.C. 154(b) by 815 days.

(21) Appl. No.: 11/989,459

(22) PCT Filed: Jul. 26, 2006

(86) PCT No.: PCT/JP2006/314725

§ 371 (c)(1),
(2), (4) Date: Jan. 24, 2008

(87) PCT Pub. No.: WO2007/013485

PCT Pub. Date: Feb. 1, 2007

(65) Prior Publication Data

US 2009/0032149 A1 Feb. 5, 2009

(30) Foreign Application Priority Data

Jul. 26, 2005 (JP) ..... 2005-215868

(51) Int. Cl.
*C21D 9/08* (2006.01)

(52) U.S. Cl. ..... 148/590; 148/570; 148/335

(58) Field of Classification Search ..... 148/590
See application file for complete search history.

(56) References Cited

U.S. PATENT DOCUMENTS 2,770,563 A * 11/1956 Herzog ..... 148/333

FOREIGN PATENT DOCUMENTS

| | | |
|---|---|---|
| JP | 55-44545 A | 3/1980 |
| JP | 59-179717 | 10/1984 |
| JP | 59-179717 A | 10/1984 |
| JP | 01-316441 | 12/1989 |
| JP | 08-246096 | 9/1996 |
| JP | 8-246096 A | 9/1996 |

(Continued)

OTHER PUBLICATIONS

English Translation of JP 59-179717 (Japanese document published on Oct. 12, 1984).*

(Continued)

*Primary Examiner* — Roy King
*Assistant Examiner* — Christopher Kessler
(74) *Attorney, Agent, or Firm* — Ladas & Parry LLP

(57) ABSTRACT

A heat treatment method of heat-treating a steel tube provides the steel tube with satisfactory workability and high pressure resistance capable of coping with a recent increasing trend of pressure dealt with by a recent common rail type fuel injection system. A steel tube of a desired size is formed by drawing a material of a steel containing at least vanadium. The steel tube is processed for normalizing by holding the steel tube at high temperatures between 950 and 1000° C. for a predetermined time and slowly cooling the steel tube at a predetermined cooling rate. Then, the steel tube is processed for tempering by heating the steel tube at a temperature between 500 and 700° C. and cooling the steel tube to an ordinary temperature at an optional cooling rate.

6 Claims, 5 Drawing Sheets

FOREIGN PATENT DOCUMENTS

| | | | |
|---|---|---|---|
| JP | 2002-295336 | | 10/2002 |
| JP | 2002-363644 | A | 12/2002 |
| JP | 2003-286543 | | 10/2003 |
| JP | 2003-286543 | A | 10/2003 |
| JP | 2004-308512 | | 11/2004 |
| JP | 2004-308512 | A | 11/2004 |
| JP | 2006-291348 | A | 10/2006 |

OTHER PUBLICATIONS

Wire Rod and Tube Drawing, ASM Handbook vol. 14, 1988, pp. 330-342.*
Patent Abstracts of Japan of JP 59-179717 dated Oct. 12, 1984.
Patent Abstracts of Japan of JP 2004-308512 dated Nov. 4, 2004.
Patent Abstracts of Japan of JP 2003-286543 dated Oct. 10, 2003.
Patent Abstracts of Japan of JP 01-316441 dated Dec. 21, 1989.
Patent Abstracts of Japan of JP 08-246096 dated Sep. 24, 1996.
Patent Abstracts of Japan of JP 2002-295336 dated Oct. 9, 2002.
Welding, E. I. "Welding Process Experiment for Manufacturing High-Pressure Container with Domestic St52 and $K_2M$ Steel." (1958) $8^{th}$ Period, pp. 11-17.
Office Action issued on Jul. 20, 2010 to corresponding Japanese Application No. 2005-215868.
Patent Abstracts of Japan English abstract of JP 8-246096 A.
Patent Abstracts of Japan English abstract of JP 2002-363644 A.
Patent Abstracts of Japan English abstract of JP 2006-291348 A.
European Search Report issued on Jul. 29, 2010 for the corresponding European application.
Patent Abstracts of Japan English abstract of JP 59-179717 A.
Patent Abstracts of Japan English abstract of JP 2004-308512 A.
Patent Abstracts of Japan English abstract of JP 55-44545 A.
Patent Abstracts of Japan English abstract of JP 2003-286543 A.

* cited by examiner

COMPARETIVE EXAMPLE

HEAT TREATMENT : NORMALIZING AT 859°C AND TEMPERING AT 679°C
(MAIN FERRITE–PEARLITE PHASE AND PARTIAL BAINITE PHASE)

EXAMPLE 9

NORMALIZING AT 1080°C AND TEMPERING AT 680°C
(BAINITE PHASE AND PARTIAL FERRITE–PEARLITE PHASE)

HIGH-STRENGTH STEEL TUBE AND HEAT TREATMENT METHOD OF HEAT-TREATING THE SAME

TECHNICAL FIELD

The present invention relates to a heat treatment method of heat-treating a high-strength steel tube. More specifically, the present invention relates to a high-strength steel tube for high-pressure piping, such as a high-pressure steel tube for high-pressure fuel piping for an automotive common rail type diesel engine, and a heat treatment method of heat-treating the high-strength tube.

BACKGROUND ART

High-strength steel tubes for high-pressure piping include those of carbon steels, and those of alloy steels containing Si and Mn, and, when necessary, Cr, Mo and/or Al in a low content. For example, a high-pressure fuel tube for an automotive common rail type diesel engine is completed by drawing a tube in a desired size, polishing the inside surface of the tube by electropolishing, chemical polishing, or fluid polishing (abrasive polishing) to ensure pressure tightness, heat-treating the tube by normalizing and annealing, surface-treating the tube by plating or the like for rust prevention, and bending the tube in a predetermined shape.

The high-pressure fuel line of the conventional automotive diesel engine is required to have mechanical properties including an yield point between about 350 and about 500 MPa, a tensile strength between about 500 and 650 MPa, and an elongation between about 22 and 35%. For example, a steel tube having an outside diameter of 6.35 mm and an inside diameter of 3.0 m and capable of being used without undergoing yielding (plastic deformation) is required to have a dynamic pressure rating between about 120 and about 190 MPa under an actual use condition. Practically, the tube has a pressure rating between 100 and 150 MPa counting on safety factor.

Generally, the high-strength steel tube has a sufficient strength for use as an automotive fuel line. However, the recent development of the common rail type diesel engine requires the development of a steel tube having still higher strength for fuel piping.

In a conventional diesel engine, fuel injection valves are connected individually to a fuel pump by fuel lines. In a common rail type diesel engine, a high-pressure fuel supplied by a pump into and accumulated in a common rail interposed between the pump and fuel injection valves, and the high-pressure fuel accumulated in the common rail is distributed to the injection valves respectively combined with cylinders. This common rail type fuel injection system accurately controls fuel injection quantity and fuel injection timing in the entire engine speed range including a low engine speed range and a high engine speed range. Thus the common rail type diesel engine, as compared with the conventional diesel engine, exhibits improved performance, can greatly improve the cleanliness of the exhaust gas, fuel consumption and engine output, and can reduce noise and vibrations.

As the injection pressure of the common rail type diesel engine is raised to cope with the yearly increasing severity of exhaust gas regulations, the need for improving silence, fuel consumption and engine output, fuel injection tubes connected to a common rail are required to have a higher pressure rating.

A technique for enhancing the strength of a fuel injection tube to be used on a common rail type diesel engine is disclosed in Patent document 1. The technique disclosed in Patent document 1 subjects a high-strength steel tube to a heat treatment at 950° C. to form a single-phase austenitic structure, and quenches the high-strength steel tube to a temperature between 350 and 500° C. by an austempering process to enhance the pressure rating and fatigue strength.

DISCLOSURE OF THE INVENTION

Problem to be Solved by the Invention

Remarkable progress of control technology and manufacturing technology has progressively raised the fuel injection pressure of the common rail type fuel injection system. Some recently developed common rail type fuel injection system operates at a maximum fuel injection pressure exceeding 160 MPa. The pressure resistance of a high-strength tube used as a conventional fuel injection tube is insufficient to withstand a maximum fuel injection pressure not lower than 160 MPa.

The high-pressure fuel line of a common rail type diesel engine not only undergoes continually repeating pressure variation, but also continually undergoes vibrations and thermal stress. Therefore, it has become impossible for the conventional high-strength tube to guarantee a dynamic pressure resistance of 160 MPa or above.

In a final process of forming a fuel injection tube, end parts of the fuel injection tube need to be shaped in connecting parts, and the fuel injection tube needs to be bent in a shape conforming to an engine on which the fuel injection tube is used. To enhance the pressure resistance, Cr, Mn and Si are added to a steel forming the fuel injection tube to enhance the strength of the fuel injection tube without significantly changing the characteristic of the steel.

There is a tendency that the variation of strength and the variation of workability are contrary to each other; that is, workability deteriorates remarkably when strength is enhanced. Such contrary relation between strength and workability is a significant problem in manufacturing a fuel injection tube having sufficiently high pressure resistance. Secondary workability, i.e., ease of processing end parts of a fuel injection tube for use on an automobile to form connecting parts and bending the fuel injection tube in a desired shape is important as well as the pressure resistance of the fuel injection tube.

Accordingly, it is an object of the present invention to solve problems in the prior art and to provide a heat treatment method of processing a high-strength steel tube to provide the high-strength steel tube with satisfactory workability and high pressure resistance capable of coping with a recent increasing trend of pressure dealt with by a recent common rail type fuel injection system.

Another object of the present invention is to provide a high-strength steel tube capable of meeting demand for increased pressure resistance required by the recent remarkable progress of fuel injection control techniques for a common rail type fuel injection system without sacrificing the secondary workability thereof in a final process for shaping the high-strength tube in a fuel injection tube.

Means for Solving the Problem

A heat treatment method of processing a steel tube formed by drawing a material of a steel containing at least V (vanadium) to improve the mechanical properties of the steel tube according to the present invention includes the steps of: normalizing the steel tube by holding the steel tube at high temperatures between 950 and 1000° C. for a predetermined time and slowly cooling the steel tube at a predetermined cooling rate; and tempering the steel tube by heating the steel tube at a temperature between 500 and 700° C. and cooling the steel tube to an ordinary temperature at an optional cooling rate.

The heat treatment according to the present invention for adjusting the mechanical properties including strength and ductility of the steel tube to those required of high-pressure tubes includes a preceding normalizing process and a succeeding tempering process. The preceding normalizing process achieves satisfactorily dissolves and precipitates V in a solid solution to improve the mechanical properties including tensile strength and yield point.

If normalizing temperature exceeds 1100° C., austenitic crystal grains in the metallographic structure grow remarkably, possibly reducing ductility necessary to ensure satisfactory secondary workability. If normalizing temperature is 950° C. or below, ferrite and pearlite crystal grains are the principal components of the metallographic structure. Such a metallographic structure makes it difficult to provide a steel tube having a desired strength.

Whereas the strength is increased, the ductility is reduced by the preceding normalizing process. The succeeding tempering process improves the reduced ductility to a ductility at the necessary lowest level to ensure satisfactory secondary workability. The metallographic structure of the precipitation-strengthened steel strengthened by the precipitation of V caused by tempering has a bainite structure as a principal structure, and the steel tube has well balanced strength and ductility.

Although the combination of hardening and tempering can form a martensitic structure to increase the strength, the same reduces the toughness and ductility remarkably. Consequently, satisfactory secondary workability cannot be ensured.

According to the present invention, the alloy steel forming the steel tube has a C content of 0.22% by weight or below, a Si content of 0.55% by weight or below, and a Mn content of 1.60% by weight or below.

A method of improving the mechanical properties of a steel increases the C, the Mn and the Si content of the steel. However, such a method deteriorates secondary workability.

Upper limits for contents for principal elements of steels for automotive high-pressure fuel tubes, such as C, Mn and Si, are specified by the DIN standards. The present invention determines an upper limit C content, an upper limit Mn content and an upper limit Si content on the basis of those specified in St52, DIN, which has sufficient achievements, and improves the strength through the promotion of precipitation of V.

If the V content exceeds 0.3% by weight, a fatigue limit ratio, namely, the ratio of fatigue limit to tensile strength, determined by a rotating-bending fatigue test reaches a maximum. If the V content is 0.1% by weight or below, the steel does not have a necessary mechanical strength.

According to the present invention, it is preferable that the V content is between 0.10 and 0.30% by weight.

According to the present invention, the normalizing process cools the steel tube at a cooling rate between 20 and 200° C./min. Such a cooling rate range is determined with an intention to determining heat treatment conditions that can be achieved by an existing continuous furnace not provided with an oil bath, such as an annealing furnace or a brazing furnace. If the cooling rate is 20° C./min or below, the principal phase of the metallographic structure is a ferrite-pearlite phase, and a steel tube of a steel having such a metallographic structure cannot have a desired strength.

A high-strength steel tube according to the present invention is formed of a steel containing C, Si, Mn and V in a C content of 0.22% by weight or below, a Si content of 0.55% by weight or below, a Mn content of 1.60% by weight or below and a V content between 0.10 and 0.30% by weight, respectively, and other elements including Fe and inevitable impurities, and having a metallographic structure principally of a bainite phase containing precipitated vanadium carbonitride grains.

The steel forming the high-strength steel tube of the present invention and having a metallographic structure principally of a bainite phase strengthened by precipitating V can be obtained by processing a steel containing V by normalizing and tempering. Thus the high-strength steel tube has properties in which strength and secondary workability are well balanced.

The heat treatment method according to the present invention can provide the high-strength steel tube with secondary workability required of steel tubes for automotive piping, and pressure resistance sufficient to withstand high pressures used by the recent common rail type fuel injection system. Fuel injection tubes to be connected to a common rail can be provided with necessary strength and secondary workability at the final stage of the heat treatment process. Therefore, the fuel injection tubes do not need to be subjected to a strength enhancing process after being processed by a secondary process. Thus high-quality fuel injection tubes can be produced at a low cost by processing the fuel injection tubes to a surface treatment process for rust prevention and a cleaning process for cleaning the interior of the fuel injection tubes to prevent clogging fuel injectors after completing the heat treatment.

The high-strength steel tube according to the present invention can meet the demand for the enhancement of pressure resistance to cope with the remarkable progress of the recent common rail type fuel injection system in fuel injection control without sacrificing secondary workability facilitating the secondary process for completing the fuel injection tubes.

BEST MODE FOR CARRYING OUT THE INVENTION

A heat treatment method in a preferred embodiment according to the present invention for heat processing a high-strength steel tube will be described with reference to the accompanying drawings.

Figure 4:
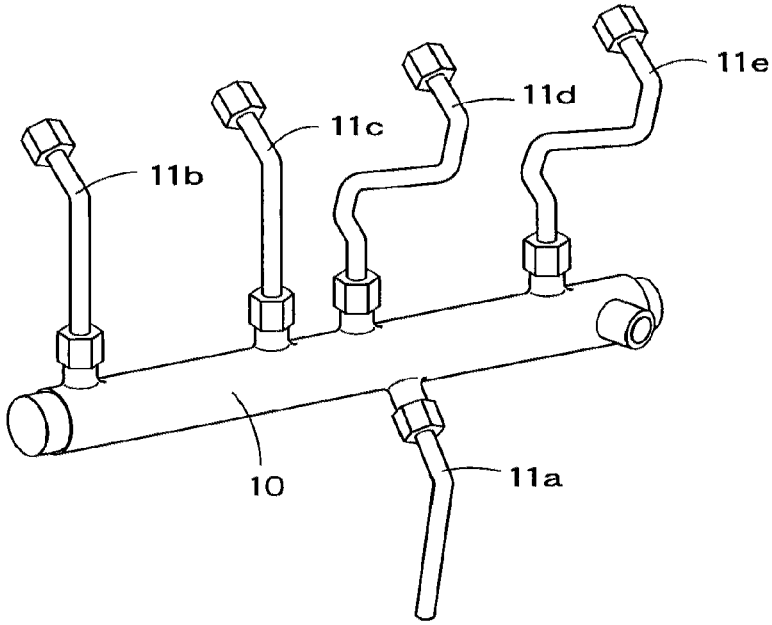
FIG. 4 is a perspective view of a common rail and fuel injection tubes for a diesel engine to which the present invention is applied.
Figure 5:
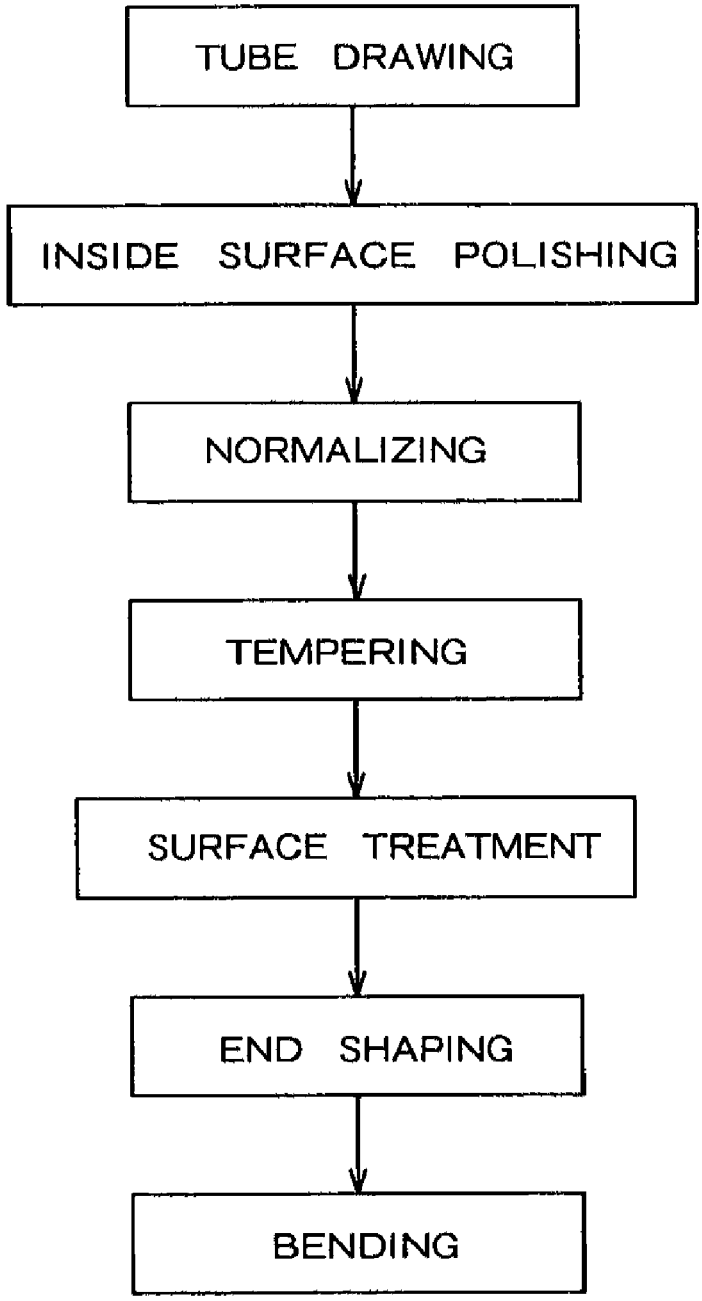
FIG. 5 is a flow chart of a fuel injection tube manufacturing process for forming the fuel injection tube of the present invention shown in FIG. 4.

FIG. 4 shows a common rail and fuel injection tubes for a diesel engine to which the present invention is applied. Shown in FIG. 4 are a common rail 10, a supply tube 11*a* for carrying fuel pumped at a high pressure by a supply pump, not shown, to the common trail 10, fuel injection tubes 11*b* to 11*e* for carrying fuel from the common rail 10 to fuel injectors combined respectively with the cylinders of the diesel engine.

A steel tube used herein is made of, for example, an alloy steel having a composition specified in St52, DIN. The composition has a C content of 0.22% by weight or below, a Si content of 0.55% by weight or below, a Mn content of 1.60% by weight or below and a V content between 0.1 and 0.3% by weight. The steel tube is drawn several times by a drawing process to form the steel tube in a desired size.

An inside surface polishing process finishes the inside surface of the steel tube in a smooth surface by electropolishing or chemical polishing to prevent stress concentration and to enhance pressure resistance.

A normalizing process holds the steel tube at high temperatures between 950 and 1100° C. for a predetermined in a heating furnace and cools the steel tube at a low cooling rate between 20 and 200° C./min.

Then, a tempering process heats the steel tube at a temperature between 500 and 700° C. in a heating furnace and cools the steel tube at an optional cooling rate to an ordinary temperature for tempering Subsequently, a surface treatment process processes the outside surface of the steel tube by a rust preventing process. An end shaping process shapes opposite end parts of the steel tube to form connecting parts. A bending process bends the steel tube in a predetermined shape. The fuel supply tube 11*a* and the injection tubes 11*b* to 11*e* are formed by those processes.

EXAMPLES

Examples of the present invention will be described.

Test pieces in Examples 1 to 7 were selected from a steel having a C content of 0.21% by weight, a Si content of 0.47% by weight, a Mn content of 1.52% by weight and a V content of 0.175% by weight. The test pieces in Examples 1 to 7 were held at different normalizing temperature shown in Table 1, respectively, for a predetermined time and then, the test pieces were cooled slowly at predetermined cooling rates, respectively, for normalizing. Then, the test pieces were processed by a tempering process. The tempering process heated the test pieces at 650° C. and cooled the test pieces to an ordinary temperature at optional cooling rates, respectively. Test pieces in examples 8 to 14 were selected from the steel. The test pieces in Examples 8 to 14 were heated at 1080° C. and were processed under the same process conditions for normalizing. Then, the test pieces in Examples 8 to 14 were heated at different temperatures, respectively, for tempering.

TABLE 1

| | Desired normalizing temperature (° C.) | Desired tempering temperature (° C.) | Measured maximum temperature (° C.) | Measured mean temperature to hold (° C.) | Measured hold time | Cooling rate (° C./min) | Ts [MPa] | Tp [MPa] | El (%) | Hardness (Hv) |
|---|---|---|---|---|---|---|---|---|---|---|
| Example1 | 940 | 650 | 940.5 | 935.6 | 3 m 55 s | 42.66 | 641.7 | 461.9 | 26.1 | 214.0 |
| Example2 | 980 | 650 | 976.5 | 972.7 | 4 m 15 s | 46.8 | 723.6 | 553.3 | 24.2 | 244.7 |
| Example3 | 1030 | 650 | 1029.0 | 1023.7 | 4 m 10 s | 51.03 | 769.1 | 611.4 | 21.5 | 268.4 |
| Example4 | 1060 | 650 | 1060.5 | 1054.8 | 3 m 55 s | 53.43 | 785.0 | 633.9 | 20.8 | 270.4 |
| Example5 | 1080 | 650 | 1080.2 | 1073.7 | 3 m 50 s | 50.18 | 787.0 | 639.2 | 20.3 | 268.6 |
| Example6 | 1100 | 650 | 1103.1 | 1096.8 | 4 m 15 s | 46.44 | 792.2 | 631.7 | 21.3 | 272.4 |
| Example7 | 1120 | 650 | 1124.9 | 1119.6 | 4 m 10 s | 38.03 | 791.6 | 638.8 | 20.7 | 276.5 |
| Example8 | 1080 | 720 | 719.8 | 714.8 | 1 m 40 s | 37.79 | 746.5 | 605.5 | 22.3 | 268.8 |
| Example9 | 1080 | 690 | 690.2 | 685.8 | 2 m 00 s | 35.23 | 786.3 | 648.0 | 21.3 | 271.9 |
| Example10 | 1080 | 660 | 670.8 | 666.1 | 2 m 10 s | 33.63 | 794.1 | 649.6 | 21.5 | 277.9 |
| Example11 | 1080 | 650 | 656.7 | 651.3 | 2 m 25 s | 35.5 | 787.0 | 639.2 | 20.3 | 268.6 |
| Example12 | 1080 | 640 | 640.6 | 636.0 | 4 m 50 s | 36.32 | 783.7 | 629.2 | 21.8 | 265.6 |
| Example13 | 1080 | 600 | 607.4 | 603.5 | 4 m 45 s | 32.45 | 772.2 | 610.1 | 21.1 | 261.4 |
| Example14 | 1080 | 500 | 514.1 | 510.7 | 4 m 35 s | 22.95 | 778.7 | 583.5 | 19.9 | 266.1 |

The test pieces in Examples 1 to 14 thus heat-treated were subjected to a tensile test hardness measurement. Shown in Table 1 are measured values of tensile strength ($T_s$), yield point ($Y_p$), elongation (El) and Vickers hardness ($H_v$).

Figure 1:
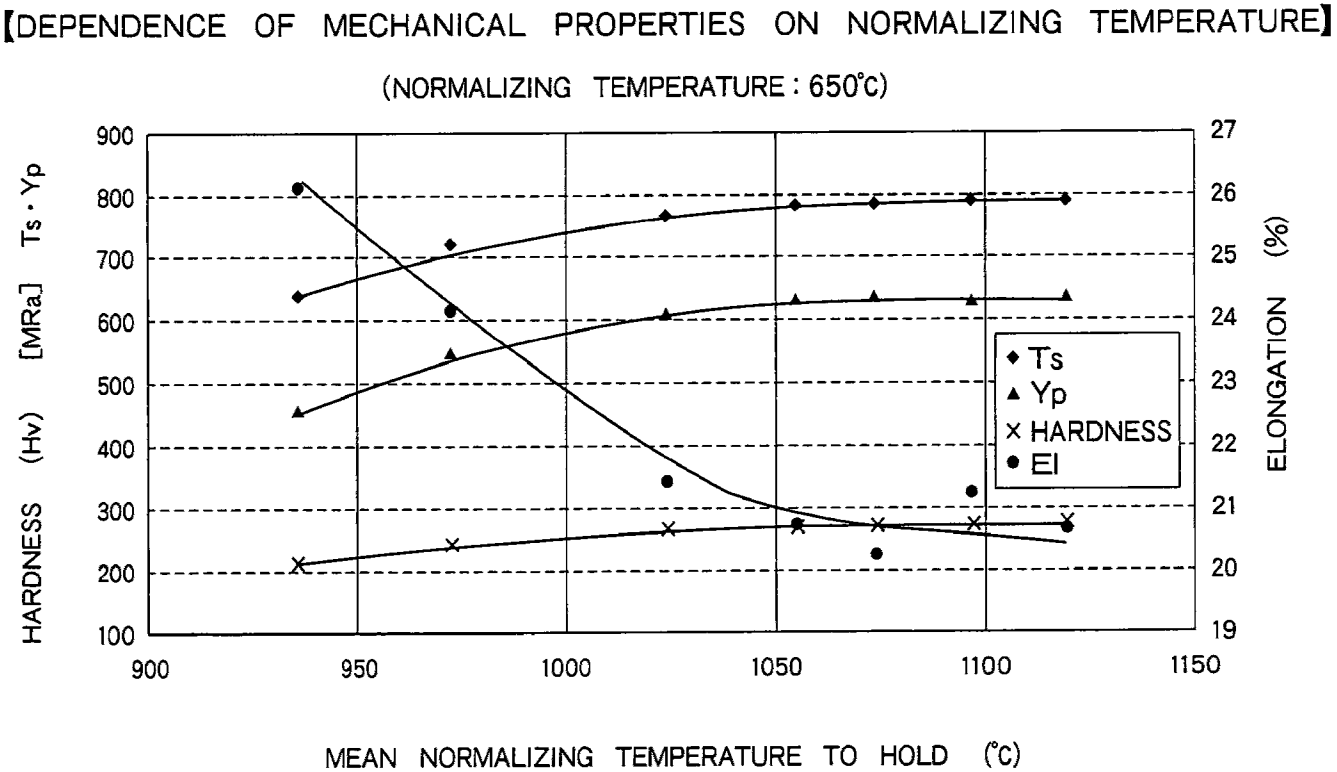
FIG. 1 is a graph showing the dependence of mechanical properties of high-strength steels in examples of the present invention on normalizing temperature.
Figure 2:
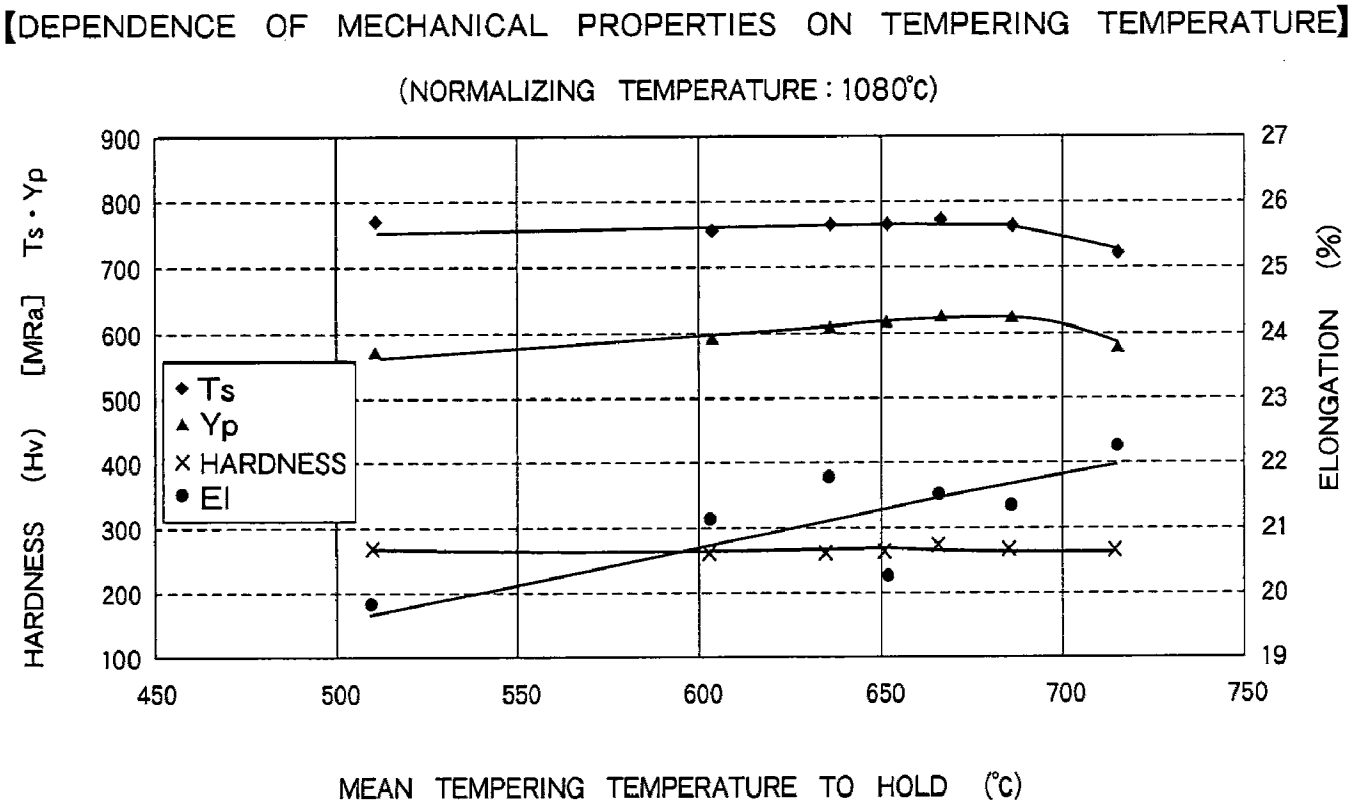
FIG. 2 is a graph showing the dependence of mechanical properties of high-strength steels in examples of the present invention on tempering temperature.

FIG. 1 is a graph showing the dependence of mechanical properties of the test pieces in Examples 1 to 7 on normalizing temperature, in which the mean of temperatures at which the test pieces were held during normalizing is measured on the horizontal axis, and results of the tensile test and measured hardness are measured on the vertical axis. FIG. 2 is a graph showing the dependence of mechanical properties of the test pieces in Examples 8 to 14 on tempering temperature, in which the mean of temperatures at which the test pieces were heated during tempering is measured on the horizontal axis, and results of the tensile test and measured hardness are measured on the vertical axis.

As obvious from FIG. 1, the tensile strength and the yield point increases while the elongation decreases with the increase of the normalizing temperature. Thus there is a general tendency that that the variation with normalizing temperature of strength and that of workability are contrary to each other.

As obvious from FIG. 2, both the tensile strength and the yield point reach their maximums at some tempering temperature and do not change greatly with tempering temperature. On the other hand, it is known that the elongation increases with tempering temperature.

It is know from the rest results that the respective effects of normalizing and tempering are complementary to each other. The strength of the steel is improved while the workability of the same is unsatisfactory when the steel is processed by normalizing. Therefore, the elongation of the steel processed by normalizing is improved by tempering.

It is known from FIG. 1 that the metallographic structure of the steel is principally of a ferrite-pearlite phase and hence the strength is not sufficiently high when the normalizing temperature is 950° C. or below, the effect of heating on improvement of the strength of the steel reaches a maximum even if the normalizing temperature is increased beyond 1050° C., and austenite crystal grains grow remarkably and elongation necessary for satisfactory secondary process cannot be ensured after the normalizing temperature is increased beyond 1100° C. Thus an appropriate normalizing temperature is between 950 and 1100° C., preferably, between 980 and 1050° C.

It is expected from FIG. 2 that the elongation is below 20%, which is the lower limit of an allowable range and the yield point drops excessively when the tempering temperature is 500° C. or below. Tempering temperatures above 700° C. are close to the A1 transformation temperature of the steel, vanadium carbonitride grains aggregate and grow. Consequently, the precipitation strengthening effect of V becomes weaker, the mechanical properties deteriorate sharply and necessary strength cannot be ensured. A proper normalizing temperature for forming the steel in a metallographic structure principally of a bainite phase and for providing the steel with well balanced strength and ductility is between 500 and 700° C., preferably, between 600 and 680° C.

Figure 6:
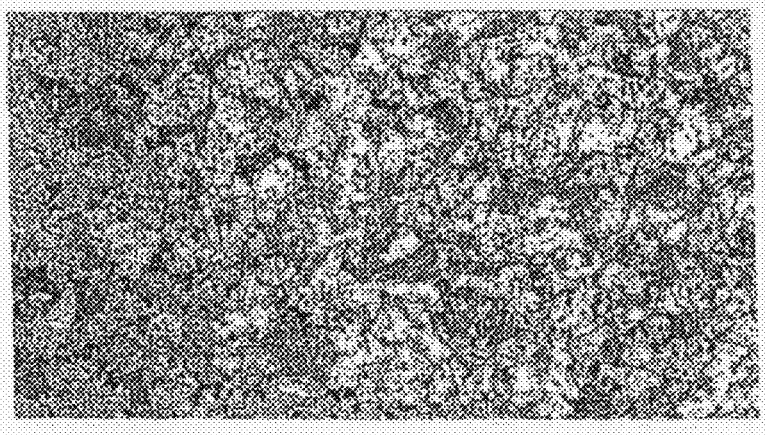
FIG. 6 is a photograph of a metallographic structure principally of a ferrite-pearlite phase in a comparative example formed by normalizing at a low normalizing temperature.
Figure 7:
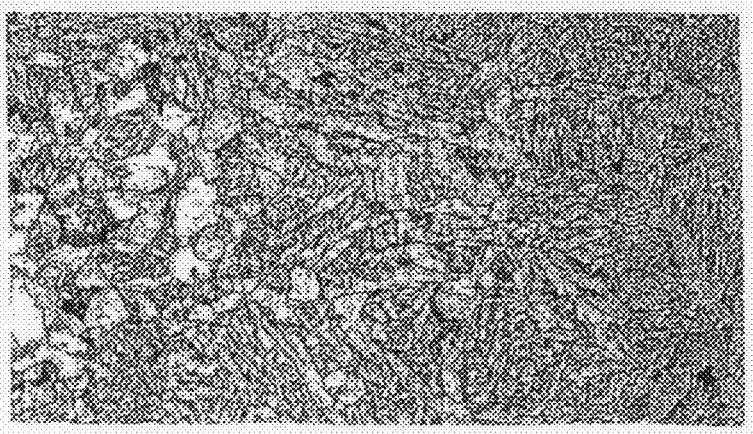
FIG. 7 is a photograph of a metallographic structure principally of a bainite phase in an example of the present invention.

FIG. 6 is a photograph of a metallographic structure of a steel in a comparative example held hot at a mean temperature of 950° C. for normalizing and held hot at a mean temperature of 680° C. for tempering. Since the steel in comparative example is heated at a low normalizing temperature of 950° C., the metallographic structure of this steel is principally of a ferrite-pearlite phase and partly of a bainite phase. FIG. 7 is a photograph of a metallographic structure of the steel in Example 9. It is obvious from FIG. 7 that The steel of Example 9 heated at 1080° C. for normalizing has a metallographic structure principally of a bainite phase.

Proper normalizing and proper tempering complement each other to provide a steel having desired mechanical properties including an yield point of about 630 MPa, a tensile strength of about 770 MPa and an elongate of about 1.5%. The strength is about 1.3 times that of the conventional steel and the elongation bears comparison with that of the conventional steel.

Figure 3:
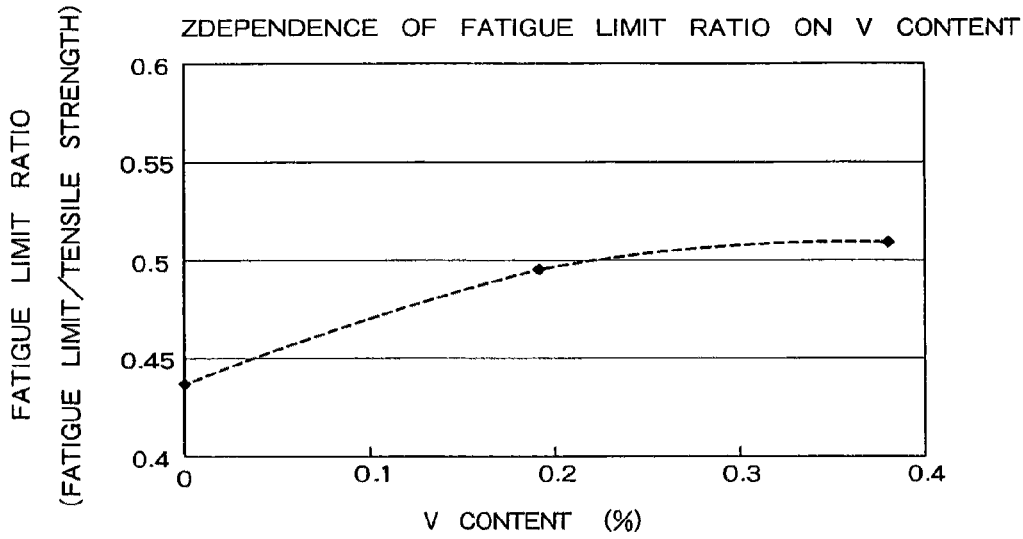
FIG. 3 is a graph showing the dependence of fatigue limit ratio on V content.

Test pieces were selected, respectively, from a steel having a C content of 0.21% by weight, a Si content of 0.45% by weight, a Mn content of 1.52% by weight and a V content of 0.2% by weight, and a steel having a C content of 0.21% by weight, a Si content of 0.45% by weight, a Mn content of 1.52% by weight and a V content of 0.4% by weight. FIG. 3 shows measured values of fatigue limit ratio, namely, the ratio of fatigue limit to tensile strength, obtained by subjecting the test pieces to a rotating-bending fatigue test.

As obvious from FIG. 4, the mechanical property improving effect of V reaches a maximum when the V content is above 0.3% by weight. It is possible that a V content of 0.1% by weight or below cannot provide the steel with necessary mechanical properties. Thus a preferable V content is between 0.1 and 0.3% by weight.

The invention claimed is:

1. A high-strength steel tube heat-treating method of processing a steel tube to improve the mechanical properties of the steel tube, the heat treatment method comprising the steps of:

forming a steel tube of a desired size by drawing a material of a steel alloyed with alloyants consisting of a C content of 0.22% by weight or below, a Si content of 0.55% by weight or below, a Mn content of 1.60% by weight or below, and a V content between 0.10 and 0.30% by weight;

normalizing the steel tube by holding the steel tube at a temperature and for a time effective to cause V in the material to dissolve and precipitate in a solid solution such that, upon subsequent tempering, the steel tube can be formed with a bainite structure as its principal metallographic structure and with improved strength;

slowly cooling the steel tube at a cooling rate between 20 and 200° C/min; and tempering the steel tube by heating the steel tube at a temperature between 500 and 700° C. and cooling to form the steel tube with a bainite structure as its principal metallographic structure.

2. The method according to claim 1, wherein the alloyants of the material consist of carbon, silicon, manganese and vanadium.

3. The method according to claim 1, wherein the temperature in the normalizing step is between 980 and 1080° C.

4. The method according to claim 1, wherein the temperature in the normalizing step is in excess of 950° C. and does not exceed 1000° C.

5. The method according to claim 3, wherein the alloyants consist of a C content of 0.1% by weight, a Si content of 0.47% by weight, a Mn content of 1.52% by weight, and a V content of 0.175% by weight.

6. The method according to claim 4, wherein the alloyants consist of a C content of 0.1% by weight, a Si content of 0.47% by weight, a Mn content of 1.52% by weight, and a V content of 0.175% by weight.

* * * * *